United States Patent [19]

Stavin et al.

[11] Patent Number: 5,018,773

[45] Date of Patent: May 28, 1991

[54] MANUAL PUSH FEEDER DEVICE FOR WOODWORKING MACHINES

[75] Inventors: Norman M. Stavin, Cozzens La., Amagansett, N.Y. 11930; Gary D. Johnson, New York, N.Y.

[73] Assignee: Norman M. Stavin, Amagansett, N.Y.

[21] Appl. No.: 381,137

[22] Filed: Jul. 14, 1989

[51] Int. Cl.[5] ..... B66C 1/00; B26D 7/06

[52] U.S. Cl. ..... 294/1.1; 294/19.1

[58] Field of Search ..... 294/1.1, 8.6, 15, 19.1, 294/57, 25; 144/242 R; 83/437, 719, 722, 723, 729; 15/143 R, 144 R

[56] References Cited

U.S. PATENT DOCUMENTS

| | | | |
|---|---|---|---|
| 1,899,871 | 2/1933 | Lake . | |
| 1,985,427 | 12/1934 | Richardson . | |
| 2,141,007 | 12/1938 | Meeh | 294/57 X |
| 2,599,938 | 6/1952 | Price et al. . | |
| 2,681,671 | 6/1952 | Norris . | |
| 2,839,100 | 6/1958 | Valicenti . | |
| 2,980,457 | 4/1961 | Page | 15/143 R X |
| 3,163,437 | 12/1964 | Phillipson . | |
| 3,601,838 | 8/1971 | Marx | 15/143 R X |
| 4,001,903 | 1/1977 | Hay . | |
| 4,253,697 | 3/1981 | Acesta | 294/19.1 X |
| 4,862,776 | 9/1989 | Poling | 294/19.1 X |

*Primary Examiner*—Margaret A. Focarino
*Assistant Examiner*—Dean Kramer
*Attorney, Agent, or Firm*—Frishauf, Holtz, Goodman & Woodward

[57] ABSTRACT

A manual push feeder device for a woodworking machine, includes a rubber base for engaging a workpiece to be moved along the woodworking machine, the base including an upper portion and a lower rubber-like pushing surface for engaging the workpiece, the lower pushing surface including a plurality of serrations or studs thereon, and a stud extending upwardly from the upper surface thereof; a handler having an upper end and a lower end with a stud thereat; a flexible connector for flexibly connecting the lower end of the handle to the base, the flexible connector including a flexible tube have an upper hole for receiving the stud of the handle and a lower hole for receiving the stud of the base; and a grip for permitting an operator to grasp and move the manual push feeder device, the grip connector to the upper end of the handle.

13 Claims, 4 Drawing Sheets

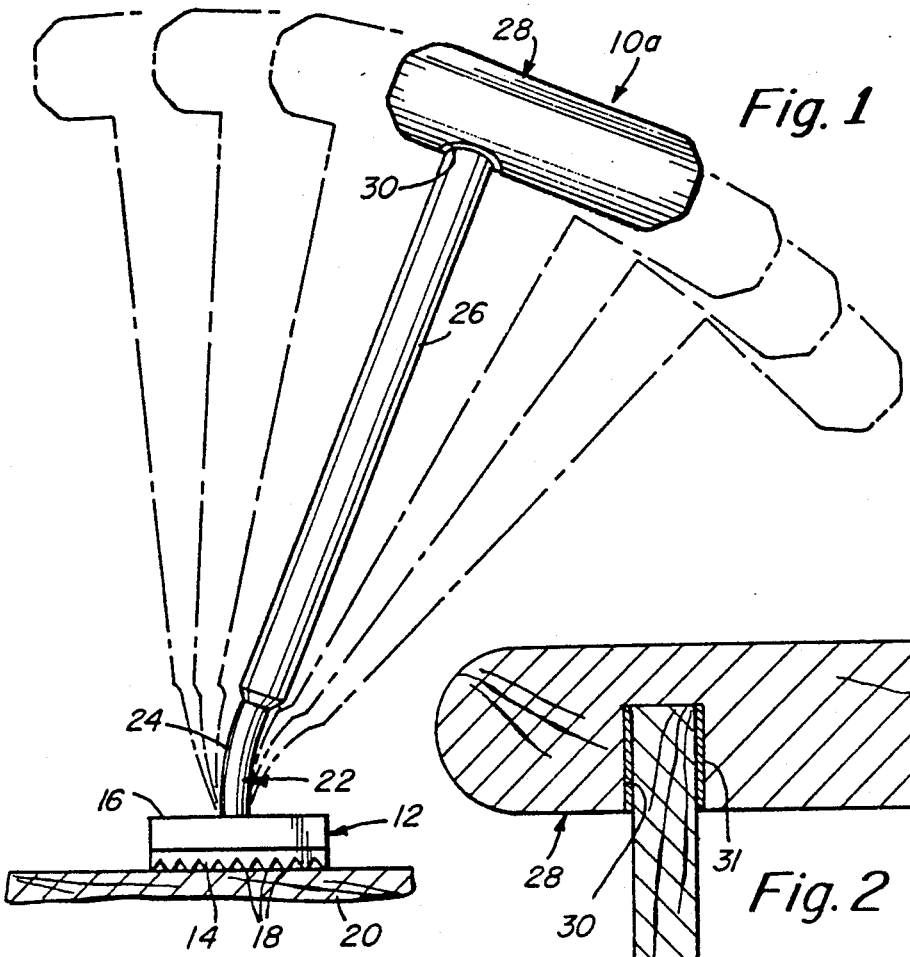
Fig. 1
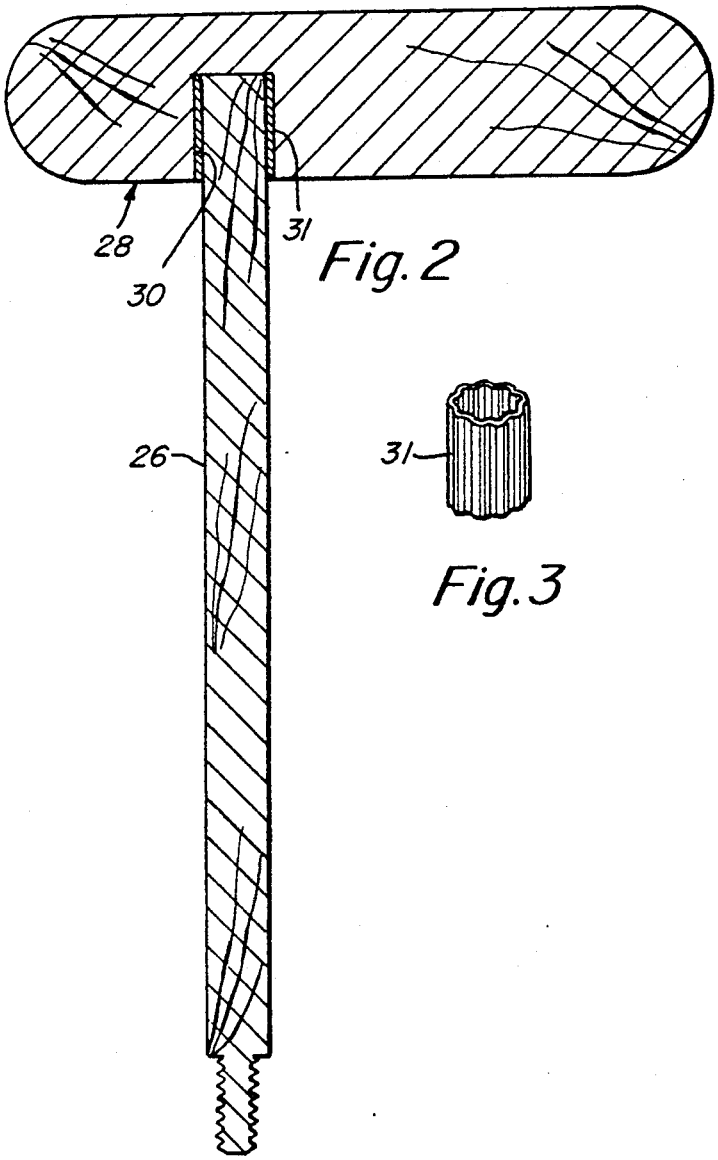
Fig. 2
Fig. 3
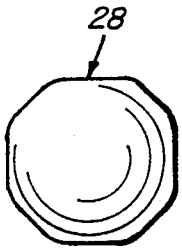
Fig. 4

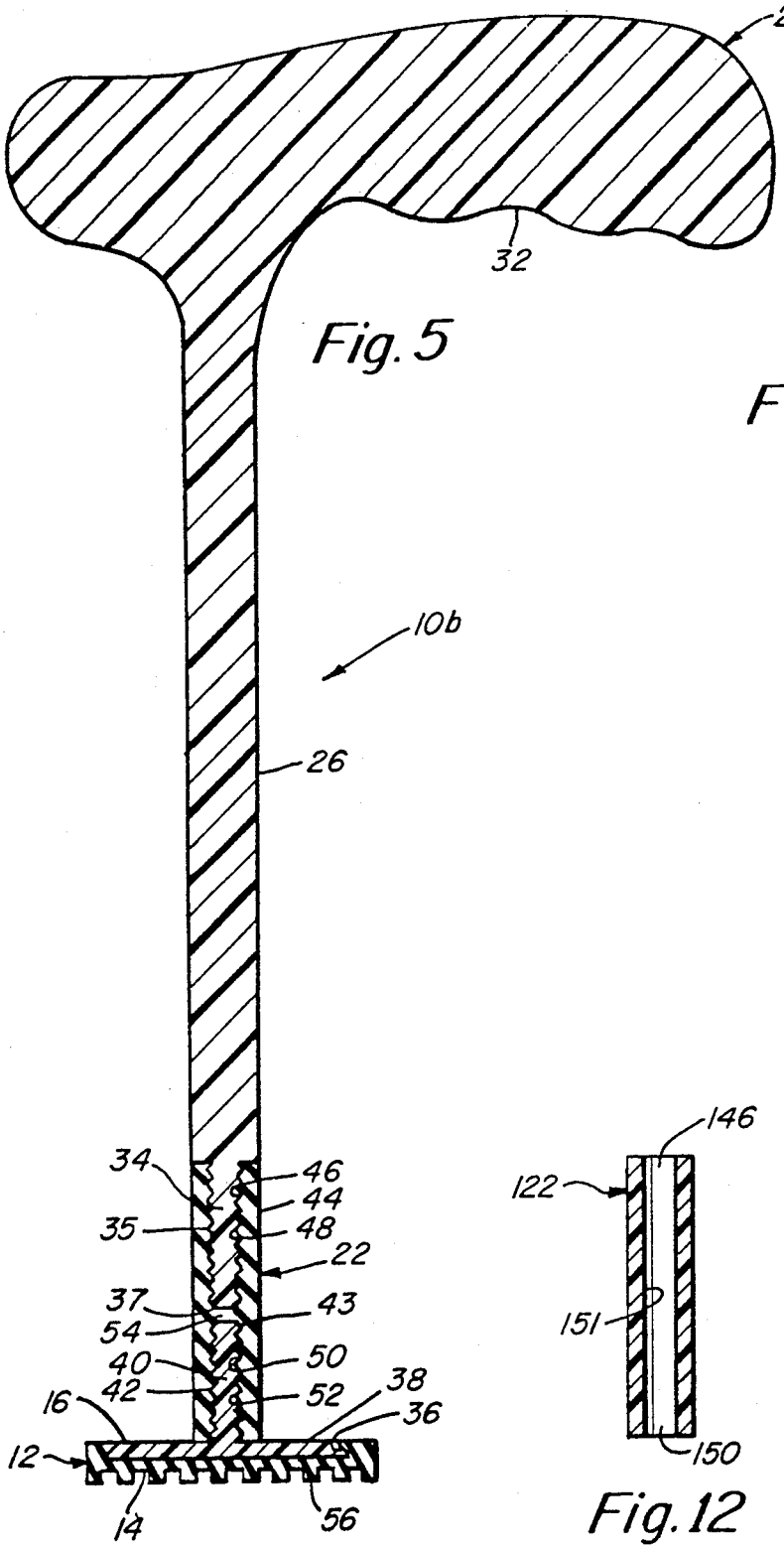
Fig. 5
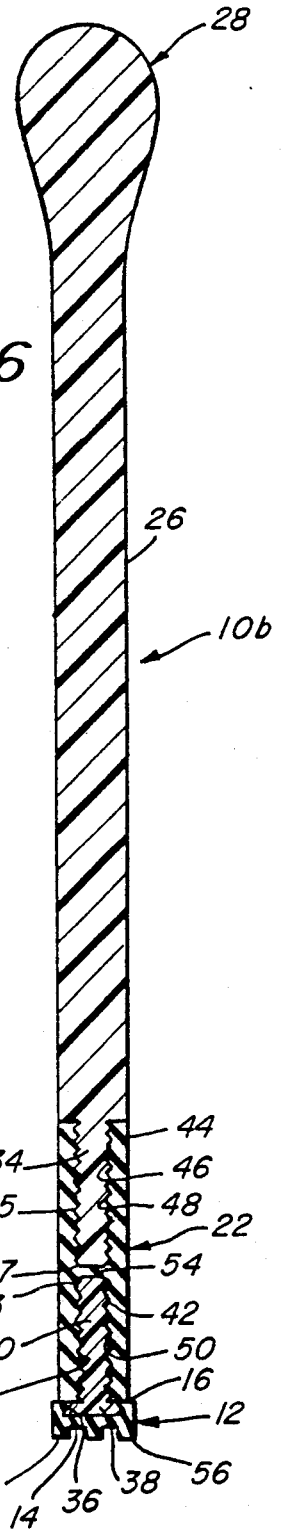
Fig. 6
Fig. 12
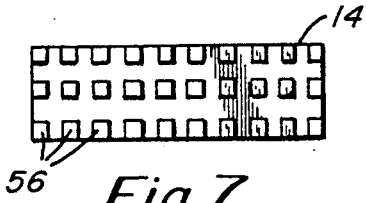
Fig. 7

MANUAL PUSH FEEDER DEVICE FOR WOODWORKING MACHINES

BACKGROUND OF THE INVENTION

This invention relates generally to a tool to aid in movement of stock through woodworking machines, and more particularly, is directed to a manual push feeder tool for moving stock through woodworking machines.

When working with woodworking machines such as circular saws, jointers, shapers and the like, the stock to be worked is pushed into engagement with the working tool of the woodworking machine. During such operation, the operator guides the stock or workpiece against a guide fence of the machine in order to obtain accurate cutting and the like by the woodworking machine.

In order to push the workpiece, the operator generally places his hands on the workpiece in order to push the same. This, however, can be dangerous since the operator's hands move very close to the working tool, such as the saw blade, of the woodworking machine.

OBJECTS OF THE INVENTION

It is an object of the present invention to provide a manual push feeder device for woodworking machines that overcomes the aforementioned problems with the prior art.

It is another object of the present invention to provide a manual push feeder device for moving a workpiece along a woodworking machine without any slipping between the workpiece and the push feeder.

It is still another object of the present invention to provide such a manual push feeder device for woodworking machines in which the operator's hands are maintained at a safe distance from the cutting or working tool of the woodworking machine.

It is yet another object of the present invention to provide such a manual push feeder device which permits pressure to be applied to the workpiece simultaneously in three directions without any damage to the workpiece.

It is another object of the present invention to provide such a manual push feeder device for woodworking machines that is relatively easy and inexpensive to use and manufacture.

The above and other objects, features and advantages of the present invention will become readily apparent from the following detailed description which is to be read in connection with the accompanying drawings.

SUMMARY OF THE INVENTION

In accordance with an aspect of the present invention, a manual push feeder device for a workpiece working machine includes base means for engaging a workpiece to be moved along the machine, the base means including a lower pushing surface for engaging the workpiece; a handle having an upper end and a lower end, the lower end being flexibly connected to the base means; and grip means for permitting an operator to grasp and move the manual push feeder device, the grip means being connected to the upper end of the handle.

BRIEF DESCRIPTION OF THE DRAWINGS

FIG. 1 is an elevational view of a manual push feeder device according to one embodiment of the present invention;

FIG. 2 is a longitudinal cross-sectional view of a portion of the manual push feeder device of FIG. 1;

FIG. 3 is a perspective view of a tolerance ring used with the manual push feeder device of FIG. 2;

FIG. 4 is an end plan view of the grip of the manual push feeder device of FIG. 2;

FIG. 5 is a longitudinal cross-sectional view of a manual push feeder device according to another embodiment of the present invention;

FIG. 6 is a longitudinal cross-sectional view of the manual push feeder device of FIG. 5, rotated by 90 degrees;

FIG. 7 is a bottom plan view of the manual push feeder device of FIG. 2;

FIG. 12 shows a modified flexible connecting means of the present invention.

DETAILED DESCRIPTION

Figure 8:
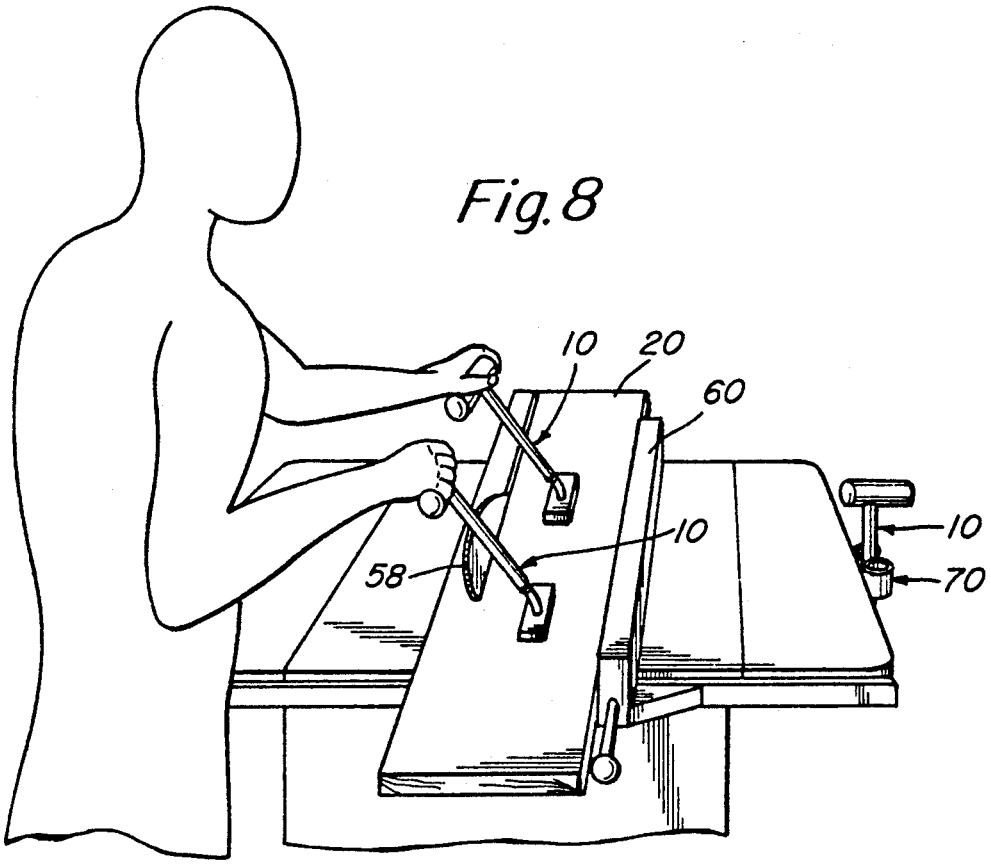
FIG. 8 is perspective view of a woodworking machine being used with a manual push feeder device according to the present invention.

Referring to the drawings in detail, and initially to FIG. 1 thereof, a manual push feeder device 10*a* according to a first embodiment of the present invention, for use with woodworking machines, includes a base 12 for engaging a workpiece to be moved along a woodworking machine. Base 12 is preferably formed by a substantially rectangular member having a rigid upper portion 16 to which is secured a layer of rubber or rubber-like material having a lower workpiece-engaging pushing surface 14. Lower pushing surface 14 preferably has serrations 18 or the like thereon for frictionally gripping a workpiece 20, such as a piece of wood or the like.

A flexible connector 22 is secured to and extends upwardly from upper portion 16. Flexible connector 22 can be formed integrally with base 12 as a short stem 24 extending therefrom, or can be formed separately and secured to base 12.

Manual push feeder device 10 further includes a rigid elongated handle 26 (i.e. made of wood, metal, plastic material or the like) having its lower end secured to the upper portion of flexible connector 22. Thus, flexible connector 22 flexibly connects handle 26 to base 12, as shown by the dashed lines in FIG. 1.

The manual push feeder device 10 further includes a substantially cylindrical upper grip 28 connected to the upper end of handle 26, whereby during use, the operator grasps grip 28 in order to move manual push feeder device 10, and thereby, workpiece 20 engaged by lower pushing surface 14 of base 12, along the woodworking machine. Preferably, as shown in FIG. 4, grip 28 has an outer hexagonal configuration. Grip 28 may be made, for example, of wood, metal, plastic material or the like.

Further, grip 28 includes a radially extending hole 30 for receiving the upper end of handle 26. It is preferable that handle 26 is secured eccentrically to grip 28, that is, at the forward end thereof, as shown in FIG. 1, for better results, although the present invention is not limited thereby. Handle 26 can be secured in hole 30 by an adhesive, screw threads, or can be press fit therein with a tolerance ring 31, as shown in FIG. 2. Tolerance ring 31, as shown in FIG. 3, is preferably a corrugated split metal sleeve that ensures maximum handle retention. Alternatively, handle 26 and grip 28 can be formed as one piece.

Various modifications can be made to the present invention. For example, referring now to FIGS. 5–7, a manual push feeder device 10*b* according to another embodiment of the present invention will be described in which elements corresponding to those of manual push feeder device 10*a* of FIG. 1 are identified by the same reference numerals, and a detailed description of such common elements will be omitted herein for the sake of brevity. As shown in the embodiment of FIGS. 5–7, grip 28 can be formed integrally at the upper end of handle 26. Thus, for example, handle 26 and grip 28 can be integrally blow molded or injection molded. Further, in the embodiment of FIG. 5, grip 28 has a larger diametrical dimension at the grasping portion thereof, and is formed with gripping depressions 32 at the underside of the grasping portion thereof to form a textured grip 28.

In the embodiment of FIGS. 5–7, flexible connector 22 is separately formed from base 12. In this regard, the lower end of handle 26 has a stud 34 formed integrally therewith which is of a lesser diameter than the remainder of handle 26, but which is coaxial therewith. Stud 34 is formed with axially spaced annular rings or threads 35 therearound, and with a chamfered free end 37. Further, base 12, which is formed as a low durometer rubber studded shoe, includes a bevel edged recess 36 formed on upper surface 16 thereof, substantially along the length thereof, with a bevel edged plate 38 mounted in recess 36. Bevel edged plate 38 includes a stud 40 extending upwardly from the center thereof, with stud 40 having axially spaced annular rings or threads 42 therearound and a chamfered free end 43. Bevel edged plate 38 and stud 40 can be formed of a one piece injection molded plastic, or can be aluminum die cast as a single piece.

Flexible connector 22 includes a flexible elastomeric tube 44 of rubber or other elastomeric material. Tube 44 includes an upper central axial hole 46 having axially spaced annular rings, ridges or threads 48 along the inner wall thereof, and a lower central axial hole 50 having axially spaced annular rings, ridges or threads 52 along the inner wall thereof. The inside diameters of axial holes 46 and 50 are slightly smaller than the outside diameters of studs 34 and 40, so that the latter are fit within the respective axial holes 46 and 50 with a friction fit. In such case, it will be appreciated that rings 35 and 48 mate to maintain stud 34 in axial hole 46, and rings 42 and 52 mate to maintain stud 40 in axial hole 50. Further, chamfered free ends 37 and 43 provide easy initial access of studs 34 and 40 into axial holes 46 and 50, respectively. The rings 35 and 42 and/or the rings 48 and 52 can be omitted and the respective surfaces can be smooth or otherwise textured to improve and maintain mutual engagement.

It will further be appreciated that there is a small land or solid portion 54 between the ends of axial holes 46 and 50. As a result, handle 26 can bend over portion 54 with respect to base 12 in the same manner as shown by the dashed lines in FIG. 1. The length of the land or solid portion 54 can be varied to provide more flexibility (if made longer) or less flexibility (if made shorter).

As shown in FIG. 12, the tubular member 22 can be replaced by a hollow tubular member 122 which is hollow throughout the complete length thereof. The upper portion of the hollow inner space comprises an upper hole 146, and the lower portion of the hollow inner space comprises a lower hole 150. Upper hole 146 engages the stud of the handle, and lower hole 150 engages the stud of the base, as in the previously described embodiments. The studs of the handle and base will be spaced from each other within the hollow inner space of the tubular member 122, the spacing between the ends of the respective studs providing sufficient free space for flexibility of the tubular member 122. The inner surface 151 of the tubular member 122 can be provided with rings, threads, ridges, serrations or any other roughened surface to improve adherence to the respective studs inserted therein, or they can be smooth, as shown in FIG. 12. Since the tubular member 122 (and also the tubular member 22) is made of elastomeric material, if the studs of the handle and/or base have ridges, rings, serrations, threads or the like thereon, they will grip the resilient inner surface of tubular member 122, even if tubular member 122 has a smooth inner surface. However, better gripping and adhesion is provided if the rings, ridges, threads or the like are provided on both the inner surface of the tubular member 122 and the outer surfaces of the respective studs. The length of the free unoccupied space between the studs, within the tubular member 122 (corresponding to the "land" 54 of FIG. 5) determines the flexibility of the flexible connecting tubular member 122.

In order to further improve adherence between the flexible tubular members 22, 122 and the respective studs on the base and handle, adhesive or glue can be used to further adhere these members together. This will further prevent relative rotation between the members or inadvertent removal of the studs from the tubular members.

Still further, the handle 26 can be offset relative to the base 12 to provide improved manipulability, as desired. That is, the stud 40 extending upwardly from the base 12 need not be at the central portion of the base 12, but can be offset to one or the other sides thereof.

Further, rather than serrations 18 on lower surface 14, as in the embodiment of FIG. 1, manual push feed device 10 of FIG. 5 includes studs 56 extending from and integrally formed on lower surface 14, as shown best in FIG. 7. It will be appreciated, however, that base 12 can be formed with a rubber studded portion secured separately to a shoe portion, and therefore, need not be formed integrally as discussed above.

In operation with respect to a circular saw machine, as shown in FIG. 8, the workpiece 20 is placed between the saw blade 58 and guide fence 60 of the machine. Then, an operator grasps grips 28 of one or two manual push feeder devices 10 and positions rubber or rubber-like serrations 18 or studs 56 on the workpiece 20 to be fed through the woodworking machine. Handle 26 is then tilted away from guide fence 60 and toward the operator, while maintaining a downward angular pressure on workpiece 20. Accordingly, serrations 18 or studs 56 maintain full contact with workpiece 20 as flexible connector 22 bends. Finally, the operator pushes forward on device 10 so as to feed workpiece 20 through saw blade 58, while maintaining angular pressure to keep workpiece 20 on the table and against guide fence 60.

Figure 8A:
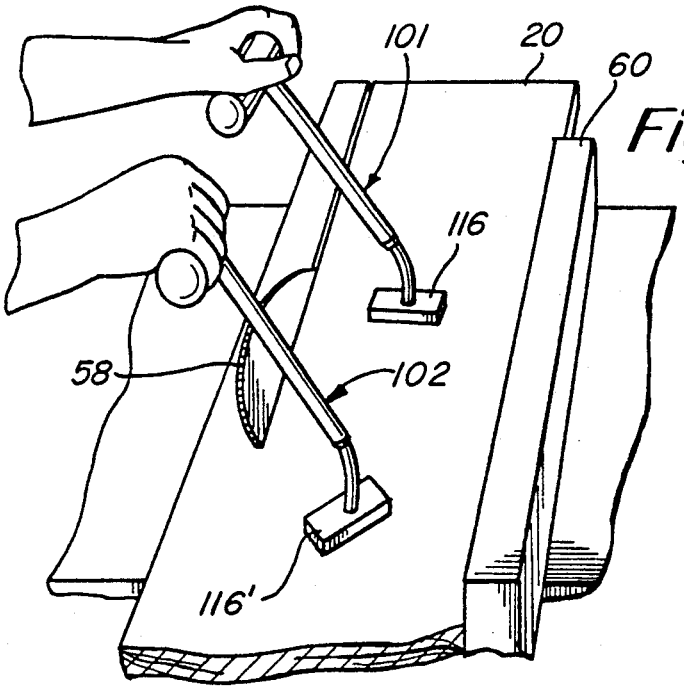
FIG. 8A is a fragmentary view similar to FIG. 8, showing modified forms of the push feeder shown in FIG. 8.

As shown in FIG. 8A, the push feeder device of the present invention can have the rectangular member 16 (to which is secured a layer of rubber or rubber-like material) oriented at an angle of about 90° relative to the direction of the handle portion, as shown by push feeder 101 in FIG. 8A. In this case, the portion 116, is approximately perpendicular to the plane of the saw blade and of the guide fence 60. Alternatively, the upper portion 116 can be oriented at any desired angle relative to the handle member, for example 45° as shown by push feeder device 102 in FIG. 8A. In this case, the upper portion 116' is oriented at approximately a 45° angle relative to the plane of the saw blade 58. Other desired angular orientations could be provided.

As should be readily apparent, the flexible connecting members 22 and the like can be either permanently fixed to the handle portion and to the member 16 (116) by means of adhesive, glue or the like, or the members can be press fit together so that they can be changed in angle by the user by twisting same, as desired. In the latter case, a frictional interference fit between the members is suitable.

Figure 9:
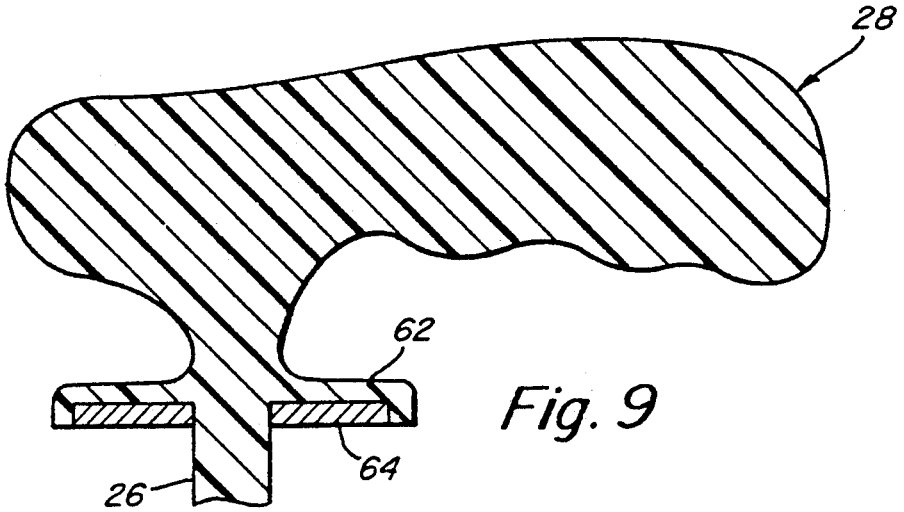
FIG. 9 is a longitudinal cross-sectional view of a manual push feeder according to another embodiment of the present invention.
Figure 10:
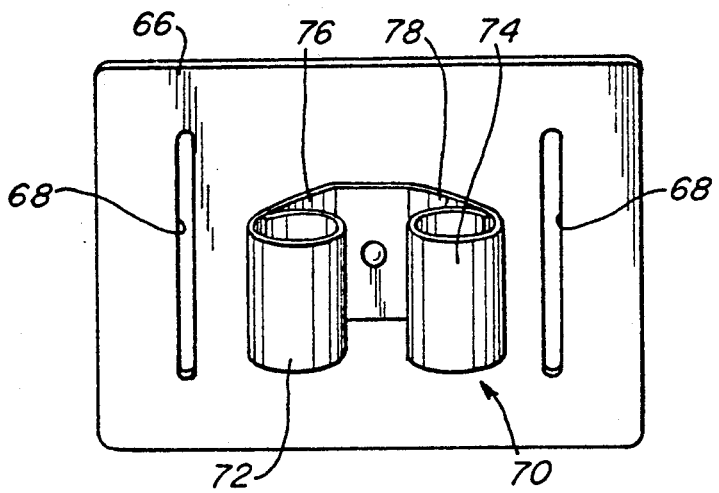
FIG. 10 is a perspective view of a belt sleeve for holding the manual push feeder device according to the present invention.
Figure 11:
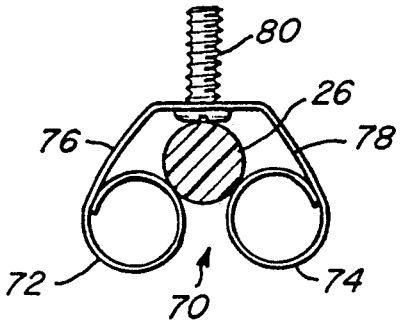
FIG. 11 is a top plan view of a machine clip for holding the manual push feeder device according to the present invention.

After the operation with the manual push feeder device has been completed, it can be easily stored at the site of the woodworking machine. For example, as shown in FIG. 9, an annular flange 62 can be provided at the upper end of handle 26, with a magnet 64 press fit thereinto. Accordingly, device 10 can be stored vertically at a metal edge of the woodworking machine. Alternatively, as shown in FIG. 10, a leather or vinyl belt sleeve 66 can be provided with spaced vertical slots 68 for receiving a belt therethrough. A plastic or metal clip 70 is mounted to sleeve 66, and for example, includes two cylinders 72 and 74 secured to sleeve 66 through leaf springs 76 and 78, respectively. Thus, handle 26 can be press fit between cylinders 72 and 74, causing the latter to move apart. As soon as handle 26 passes to the interior space therebetween, cylinders 72 and 74 move together to grasp handle 26. Cylinders 72 and 74 and leaf springs 76 and 78 are preferably formed from a single sheet of sheet metal that is secured to sleeve 66, and which is coiled at its ends to form cylinder portions 72, 74. As another alternative, clip 70 can be secured by a screw 80 or the like, or by adhesive or "hook-and-loop" fasteners, to the woodworking machine, as shown in FIGS. 8 and 11.

Thus, with the present invention, a manual push feeder device 10 is provided for moving a workpiece 20 along a woodworking machine without any slipping, and whereby the operator's hands are maintained at a safe distance from the cutting or working tool of the woodworking machine. Further, pressure can be safely applied to workpiece 20 simultaneously in at least three directions without any damage to the workpiece, that is, forward through the cutting tool 58, down against the table and sideways against a guide fence 60.

Various modifications can be made to the invention herein. For example, although grip 28 has been shown as a cylindrical or tubular member, grip 28 can have any other suitable configuration such as a ball-shaped member, D-shaped member, T-shaped member or the like. The members 16, 38, 116, 116' can be of any desired shape other than rectangular as shown. Further, any other suitable means for forming flexible connector 22 can be provided, such as a solid flexible rod for handle 26, a universal joint or linkage, or the like.

Having described specific preferred embodiments of the invention with reference to the accompanying drawings, it will be appreciated that the present invention is not limited to those precise embodiments and that various changes and modifications can be effected therein by one of ordinary skill in the art without departing from the spirit of scope of the invention as defined by the appended claims.

What is claimed is:

1. A manual push feeder device for moving a workpiece along a workpiece working machine, comprising:

base means for non-slipping engaging a workpiece to be moved along the machine, said base means including a lower pushing and engaging surface means for non-slipping engaging the workpiece such that the workpiece moves with movement of said lower surface means;

a handle having an upper end portion and a lower end portion;

flexible connecting means for flexibility coupling said lower end portion of said handle to said base means and to transmit movement forces applied to said handle to said base means;

said base means including a stud extending upwardly therefrom;

said lower end portion of said handle including a stud thereat;

said flexible connecting means having an upper hole for receiving said stud of said handle and a lower hole for receiving said stub of said base means, and having a flexible portion between ends of the studs received in said upper and lower holes;

at least one of said studs and inner surface portions of said respective holes of said flexible connecting means having indentations and projections thereon for frictionally engaging the other of said studs and said inner surface portions of respective holes of said flexible connecting mans; and grip means coupled to said upper end portion of said handle for permitting an operator to grasp said grip means and move said manual push feeder device and to correspondingly move the workpiece, when said lower surface means is engaged with a workpiece.

2. A manual push feeder device according to claim 1, wherein said lower pushing surface means includes a plurality of studs thereon.

3. A manual push feeder device according to claim 1, wherein said lower pushing surface means includes a plurality of serrations thereon.

4. A manual push feeder device according to claim 1, wherein at least said lower surface means of said base means is made from a rubber or rubber-material.

5. A manual push feeder device according to claim 1, wherein said grip means is integrally formed with said handle.

6. A manual push feeder device according to claim 1, wherein said grip means includes a hole therein, and said upper end of the handle is secured in said hole of said grip means.

7. A manual push feeder device according to claim 1, wherein said flexible connecting means for flexibly connecting said lower end portion of said handle to said base means comprises a flexible tubular member.

8. A manual push feeder device according to claim 7, wherein said upper and lower holes are axially aligned and spaced from each other in the axial direction thereof.

9. A manual pusher feeder according to claim 7, wherein said flexible tubular member is solid in said space between said holes.

10. A manual pusher feeder according to claim 1, wherein said indentations and projections are on said studs, and comprise alternate indentations and projections spaced along the respective studs and extending in the circumferential direction of the respective studs.

11. A manual pusher feeder according to claim 1, wherein said studs contact the inner surfaces of the respective holes of said flexible connecting means over substantially the complete length of the portion of said studs which are inserted into said respective holes.

12. A manual push feeder device according to claim 10, wherein said alternate indentations and projections of said studs comprise threads, and said upper and lower holes have threads therein for mating with said threads of said studs.

13. A manual push feeder device according to claim 10, wherein said alternate indentations and projections of said studs comprise rings or ridges, and said upper and lower holes have rings or ridges therein for engaging said rings or ridges of said studs.

* * * * *